US009162192B2

(12) United States Patent
Tassone et al.

(10) Patent No.: US 9,162,192 B2
(45) Date of Patent: Oct. 20, 2015

(54) APPARATUS AND METHOD FOR METERING, MIXING AND PACKAGING SOLID PARTICULATE MATERIAL

(75) Inventors: Giuseppe Tassone, Simbario (IT); Francesco Tassone, Simbario (IT)

(73) Assignee: Personal Factory S.P.A., Simbario (VV) (IT)

( * ) Notice: Subject to any disclaimer, the term of this patent is extended or adjusted under 35 U.S.C. 154(b) by 1174 days.

(21) Appl. No.: 13/126,928

(22) PCT Filed: Oct. 28, 2009

(86) PCT No.: PCT/EP2009/064240

§ 371 (c)(1),
(2), (4) Date: Apr. 29, 2011

(87) PCT Pub. No.: WO2010/049464

PCT Pub. Date: May 6, 2010

(65) Prior Publication Data

US 2011/0211418 A1 Sep. 1, 2011

(30) Foreign Application Priority Data

Oct. 30, 2008 (IT) ..... CZ2008A0010

(51) Int. Cl.
*B01F 3/18* (2006.01)
*B01F 7/04* (2006.01)
(Continued)

(52) U.S. Cl.
CPC ... *B01F 3/18* (2013.01); *B01F 7/04* (2013.01); *B01F 13/1005* (2013.01); *B01F 15/00194* (2013.01); *B01F 15/00311* (2013.01);
(Continued)

(58) Field of Classification Search
CPC ..... B01F 7/02; B01F 7/04; B01F 13/04; B01F 3/18; B01F 13/1005; B01F 15/00311; B01F 15/0292; B01F 15/0445; B01F 15/00194; B01F 15/0267; B01F 15/0234; B65B 1/22; B65B 1/32; B65B 1/08; B65B 61/28
USPC ..... 366/141, 80, 308, 325.4, 325.8, 325.9, 366/325.91, 325.93
See application file for complete search history.

(56) References Cited

U.S. PATENT DOCUMENTS 2,591,721 A * 4/1952 Poulsen ..... 366/133
3,457,880 A * 7/1969 Eppenberger ..... 425/186
(Continued)

FOREIGN PATENT DOCUMENTS

DE 972193 6/1959
DE 3923241 A1 1/1991
(Continued)

*Primary Examiner* — Nahida Sultana
(74) *Attorney, Agent, or Firm* — Novak Druce Connolly Bove + Quigg LLP

(57) ABSTRACT

The present invention relates to a method and an apparatus to produce solid particulate material from solid particulate components. The components are metered and mixed according to a desired recipe. After having been mixed the material is metered and packaged in a suitable form, e.g. in bags. The apparatus (10) comprises a stationary casing (32) provided with a rotating mixing tool (40), a discharge valve (50) mounted on the bottom of said mixer (30) and a metering and packaging unit (70).
The method is particularly suitable to manufacture solid particulate material by mixing low-value components available in any site and high-value components, such as materials for use in the building and construction field.

9 Claims, 8 Drawing Sheets

(51) Int. Cl.

| | |
|---|---|
| ***B01F 13/10*** | (2006.01) |
| ***B01F 15/00*** | (2006.01) |
| ***B01F 15/02*** | (2006.01) |
| ***B01F 15/04*** | (2006.01) |
| ***B65B 1/08*** | (2006.01) |
| ***B65B 1/22*** | (2006.01) |
| ***B65B 1/32*** | (2006.01) |
| ***B65B 61/28*** | (2006.01) |

(52) U.S. Cl.

CPC ..... *B01F15/0234* (2013.01); *B01F 15/0267* (2013.01); *B01F 15/0292* (2013.01); *B01F 15/0445* (2013.01); *B65B 1/08* (2013.01); *B65B 1/22* (2013.01); *B65B 1/32* (2013.01); *B65B 61/28* (2013.01)

(56) References Cited

U.S. PATENT DOCUMENTS

| | | | | |
|---|---|---|---|---|
| 3,707,172 | A | 12/1972 | Obara | |
| 3,889,448 | A * | 6/1975 | Russell | 53/122 |
| 3,959,636 | A | 5/1976 | Johnson et al. | |
| 4,147,437 | A * | 4/1979 | Jonqueres | 366/343 |
| 4,459,028 | A * | 7/1984 | Bruder et al. | 366/141 |
| 4,525,071 | A | 6/1985 | Horowitz et al. | |
| 4,586,824 | A * | 5/1986 | Haws | 366/34 |
| 4,703,782 | A * | 11/1987 | Henkel, Sr. | 141/65 |
| 5,332,311 | A * | 7/1994 | Volk et al. | 366/134 |
| 5,466,894 | A | 11/1995 | Naef | |
| 5,627,346 | A | 5/1997 | Weibel et al. | |
| 8,690,417 | B2 * | 4/2014 | Graf et al. | 366/76.2 |
| 2005/0169100 | A1 * | 8/2005 | Chida et al. | 366/169.2 |
| 2006/0115101 | A1 * | 6/2006 | Schoenberger | 381/120 |
| 2010/0052206 | A1 * | 3/2010 | Kerr et al. | 264/211.11 |
| 2011/0192791 | A1 * | 8/2011 | Takase et al. | 210/612 |
| 2011/0319518 | A1 * | 12/2011 | Kadonaga et al. | 522/86 |
| 2014/0148561 | A1 * | 5/2014 | Paul et al. | 526/64 |

FOREIGN PATENT DOCUMENTS

| | | | |
|---|---|---|---|
| DE | 20308984 | U1 | 8/2003 |
| EP | 1382381 | A1 | 1/2004 |
| JP | 59-150530 | A | 8/1984 |
| JP | 11-208460 | A | 8/1999 |
| WO | WO-98/51458 | A1 | 11/1998 |

* cited by examiner

APPARATUS AND METHOD FOR METERING, MIXING AND PACKAGING SOLID PARTICULATE MATERIAL

CROSS REFERENCE TO RELATED APPLICATIONS

This application is a National Phase filing under 35 U.S.C. §371 of PCT/EP2009/064240 filed on Oct. 28, 2009; and this application claims priority to Application No. CZ2008A000010 filed in Italy on Oct. 30, 2008 under 35 U.S.C. §119; the entire contents of all are hereby incorporated by reference.

DESCRIPTION

The present invention relates to an apparatus and a method for metering, mixing and packaging solid particulate material. More particularly the invention relates to an apparatus for metering, mixing and packaging solid particulate material for use in the building and construction field.

The main components of solid particulate material for use in the building and construction field are typically sand and cement. Depending on the application, the material may contain also high-value components such as adhesives and/or other chemical products. Typically such high-value components represent a small fraction of the total material, for example from 10 to 5% by weight, or even less, of the total composition. The production of the material comprises metering the required amount of each component according to an appropriate recipe, mixing the components to obtain a uniform composition, and packaging the final composition in a substantially dry form suitable to storage and transportation, typically in a bag. The steps above are performed in a manufacturing plant at a manufacturing site, from which the bags are usually transported to a resale site, where the material is offered for sale to customers in the surrounding area. The resale site is often far away from the manufacturing site. This has an impact on transportation costs. Since the high-value components are only a small fraction of the material, what is transported from the manufacturing site to the resale site is to a very large extent sand and cement, namely the low-value components of the composition.

Although generally accepted, this situation is not satisfactory since it is not desirable to transport large amounts of low-value components such as sand and cement from a manufacturing site to a remote resale site.

Mixing of solid particulate material is carried out in a variety of mixers.

Industrial mixing devices currently available on the market are of the drum type and are composed of a hollow cylinder positioned horizontally, provided internally with a shaft to which blades are attached. Typically the mixer opens completely from below and instantly discharges all the material which falls into a storage hopper. The material is then discharged into the filling hopper of a bagging machine by means of an auger conveyor.

U.S. Pat. No. 4,403,865 describes a drum mixer, in which the drum is in the shape of a double cone connected by a cylindrical part, inside which wings are provided to facilitate mixing of the components when the mixer rotates in one direction and which, once the mixture is ready, rotates in the opposite direction to facilitate exit of the mixture. The mixture exits through a mouth that does not allow metering of the quantity of mixed material as all the mixed material is discharged instantly. Another drawback of the device described in U.S. Pat. No. 4,403,865 is that the material is not finely mixed, as there is no rotation of the wings with respect to the drum. The wings present in the drum have the purpose of guiding the powdered material to be mixed in a given direction.

EP 1 382 381 A1 discloses a horizontal mixer with a tall design. The mixer comprises a drum formed by a cylindrical vessel with two curved end walls. Mixing tools are mounted radially on the horizontal shaft to operate only in the region inside the cylindrical vessel, i.e. they do not rotate inside the space created by the curved end walls. Discharge of the material after mixing is carried out by opening a lower door. The structure of this mixer and the operation of the mixing tool in the central portion of the drum only does not ensure a satisfactory mixing of the solid particulate material.

Finally, a metering machine and a storage hopper must be provided to the mixers mentioned above to allow bagging of the material.

There thus exists a need both for an efficient method of manufacturing particulate material for use in the building and construction field, and for an improved mixer to be used in such method.

Also, there is a need for a mixer which ensure an optimal mixing of material and which simultaneously allows metering of the components of the material and efficient packaging of the material that has been mixed.

An object of the present invention is to provide a method for producing solid particulate material, particularly for use in the building and construction field, without the need to transport a ready-for-use material from a production site to a remote resale site.

Another object of the present invention is to provide an improved, compact and easy to operate apparatus for metering, mixing and packaging solid particulate material.

A first aspect of the invention relates to a method for producing solid particulate material from solid particulate components, characterized by comprising the following steps:

a) sequentially feeding at least two components of solid particulate materials to a metering unit;
b) sequentially metering each of said component in said metering unit according to a predetermined recipe;
c) transferring said components into a mixing unit;
d) mixing said components in said mixing unit to form a particulate material fulfilling said predetermined recipe;
e) discharging said particulate material from said mixing unit, simultaneously metering a predetermined amount of said particulate material and transferring said metered amount into a container located downstream said mixing unit.

A second aspect of the invention relates to an apparatus for producing solid particulate material, comprising storage tanks for separately storing at least two different components of a solid particulate material, characterized by further comprising:

a) a metering unit for said components of a solid particulate material;
b) a mixer comprising a stationary casing provided with a rotating mixing tool;
c) a discharge valve mounted on the bottom of said mixer;
d) a metering and packaging unit located downstream said mixer.

Another aspect of the invention relates to the structure of the mixer according to point b) above, which comprises a stationary casing provided with an upper loading port and with an internal mixing tool mounted on a rotating horizontal shaft actuated by driving means located outside said casing, said mixer being characterized in that:

said casing comprises two frusto-conical walls joined at their bases and disposed with their axis aligned horizontally, said shaft being mounted horizontally along said axis of said frusto-conical walls;

said mixing tool comprises a plurality of spokes mounted on the centre of the portion of said shaft contained within said casing, each of said spokes being provided with a blade in the proximity of said frusto-conical walls;

said casing is provided with a discharge port associated to a discharge valve mounted on the bottom of the casing.

The method according to the invention allows to produce a solid particulate material by mixing solid particulate components according to a desired recipe, and to package a desired amount of the material so produced in an efficient way. The method is particularly advantageous in the production of solid particulate material for use in the building and construction field.

A variety of materials are used in the building and construction field, including cement based adhesives, products for wall covering, cement-based flooring systems, products for consolidating masonry, and the like. Most of such materials are mixtures of a large amount of low-value components such as sand and cement, and a small amount of high-value components such as adhesives, special resins and/or other chemicals. The material is manufactured usually by mixing the various components according to a desired recipe. The mixing is carried out until a desired uniformity of the mixture is obtained. The material is then packaged in a suitable form, for example in bags, then it is stored until it is delivered to a resale site, where the material is offered for sale to customers. Since resale sites are often far away from the manufacturing site, delivery to the resale site involve substantial transportation costs.

The method of the invention allows to improve the overall efficiency of the production and distribution of materials in solid particulate form, particularly for use in the building and construction field. The method allows to manufacture a material according to a desired recipe directly at a resale site, thus reducing significantly the transportation cost from a single manufacturing site to a plurality of remote resale sites. In particular the method allows to use the wide availability of low-value components such as sand and cement in the production of a material in solid particulate form directly at a resale site.

The method of the invention can be managed in several ways. According to one aspect, a manufacturer of the material provides a recipe to a reseller together with the high-value components of the recipe, which are usually present in small amounts in the material. The recipe typically requires also low-value components, which are usually present in large amounts in the material. The reseller purchase such low-value components in the local market, within which the transportation costs are low, then manufactures the material according to the desired recipe.

The components are stored in suitable tanks.

The first step of the method comprises feeding sequentially each component of the solid particulate materials to a metering unit.

The second step comprises metering each component in said metering unit according to a predetermined recipe.

The third step comprises simultaneously transferring each component that has been metered into a mixing unit. Preferably the components are transferred simultaneously by gravity.

The fourth step comprises mixing said components in a mixing unit to form a mixture of particulate material having a desired uniformity and fulfilling a desired and predetermined recipe.

The fifth step comprises discharging said particulate material from said mixing unit in a substantial continuous way, simultaneously metering a predetermined amount of particulate material and transferring said metered amount into a container located downstream said mixing unit, typically a bag.

The method above is conveniently and efficiently carried out by using an apparatus for producing solid particulate material according to another aspect of the invention. Such apparatus is described with reference to the enclosed figures, in which.

Figure 1:
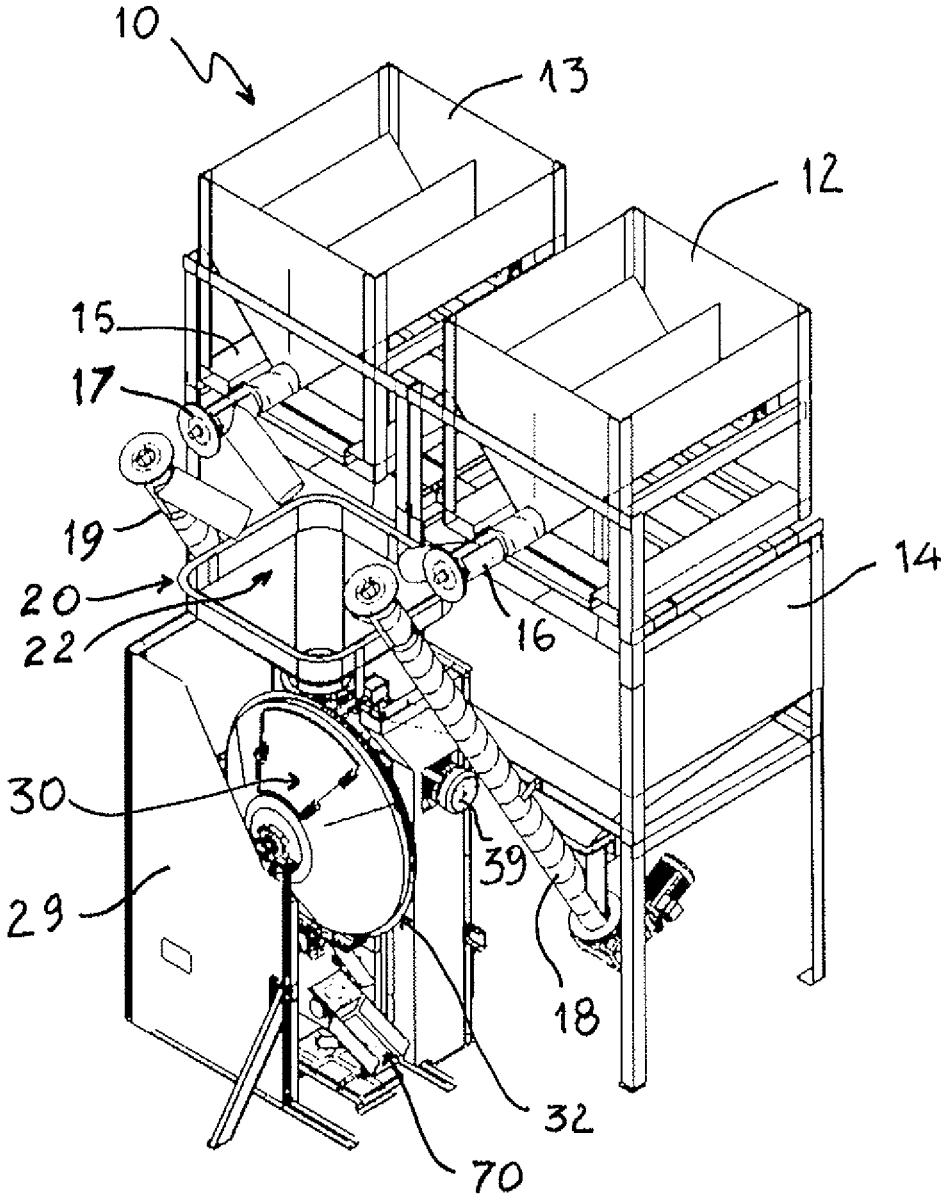
FIG. 1 is a schematic perspective view of an apparatus according to the invention.
Figure 2:
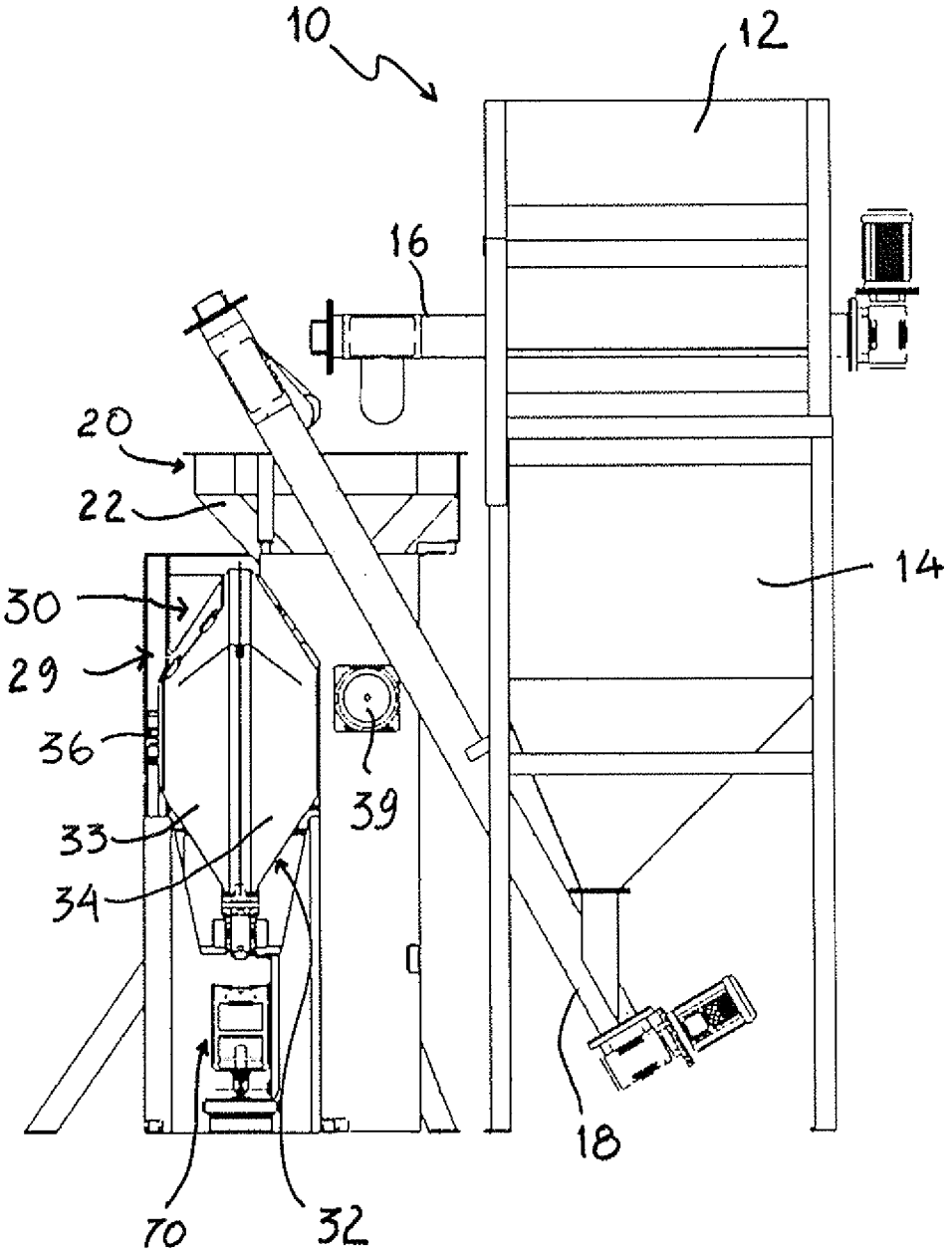
FIG. 2 is an elevation view of the apparatus of FIG. 1.

With reference to FIGS. 1 and 2, the apparatus according to the invention is designated with 10. It comprises storage tanks 12, 13, 14, 15, for separately storing at least two different components of a solid particulate material. In the embodiment shown in the figures, up to four components can be separately stored in the four storage tanks 12, 13, 14, 15, mounted on a supporting structure in two superimposed rows. The upper storage tanks 12, 13 are movable, namely they can be lifted from the support structure to allow filling of the lower tanks 14, 15. Each tank is provided with an auger conveyor 16, 17, 18, 19 to withdraw the components stored in tanks 12, 13, 14, 15 and feed them to a metering unit 20. The auger conveyors are actuated by motors and are controlled by a central control unit, not shown.

Figure 3:
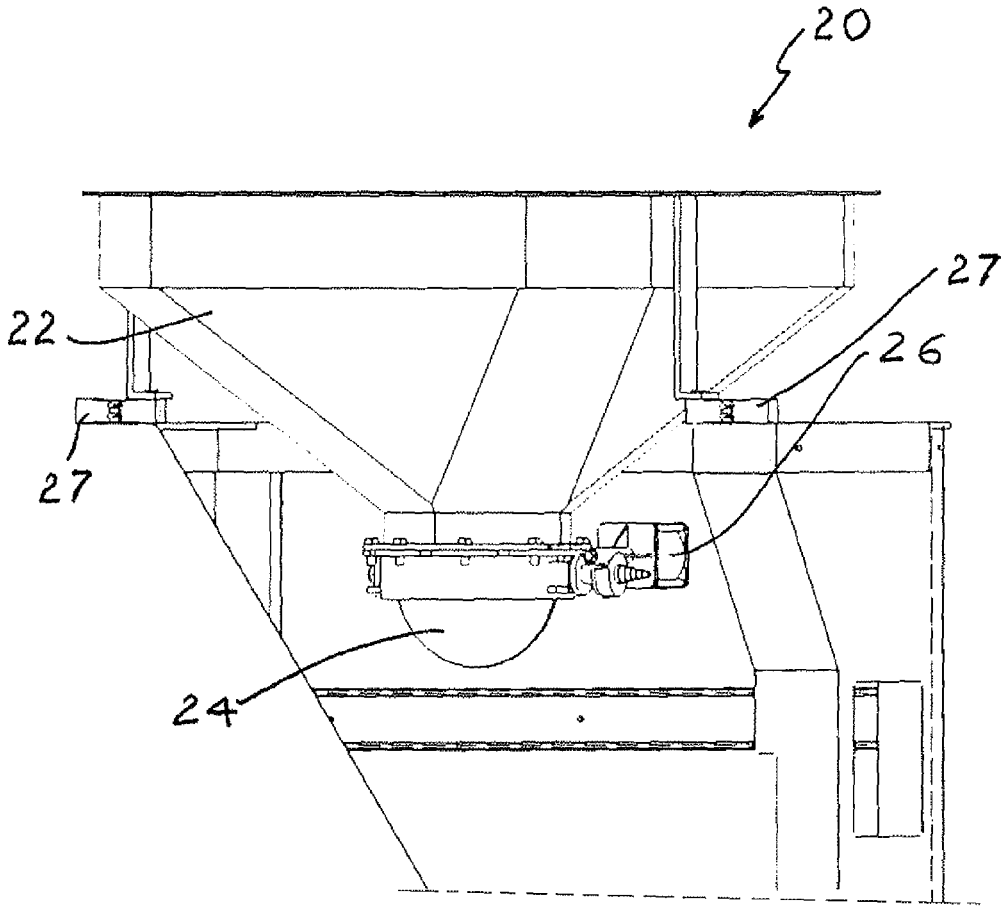
FIG. 3 is an enlarged elevation view of a part of the apparatus of FIG. 1.

Metering unit 20 comprises a hopper 22, as shown also in FIG. 3. Hopper 22 has an opening at the bottom closed by a closure disc 24 rotating around a shaft aligned with its diameter, so that disc 24 can be in a closed position and in an open position, as shown in FIG. 3. Actuation of disc 24 from/to an open/closed position is achieved by a pneumatic actuator 26. In the open position the material can be discharged from hopper 22. Hopper 22 is equipped with metering means 27, preferably based on load cells, as known in the field of industrial weighing systems. Each component of the material fed to hopper 20 can thus be metered according to a desired amount and discharged from the metering unit by opening disc 24. This is operated sequentially, namely one component after the other.

Figure 4:
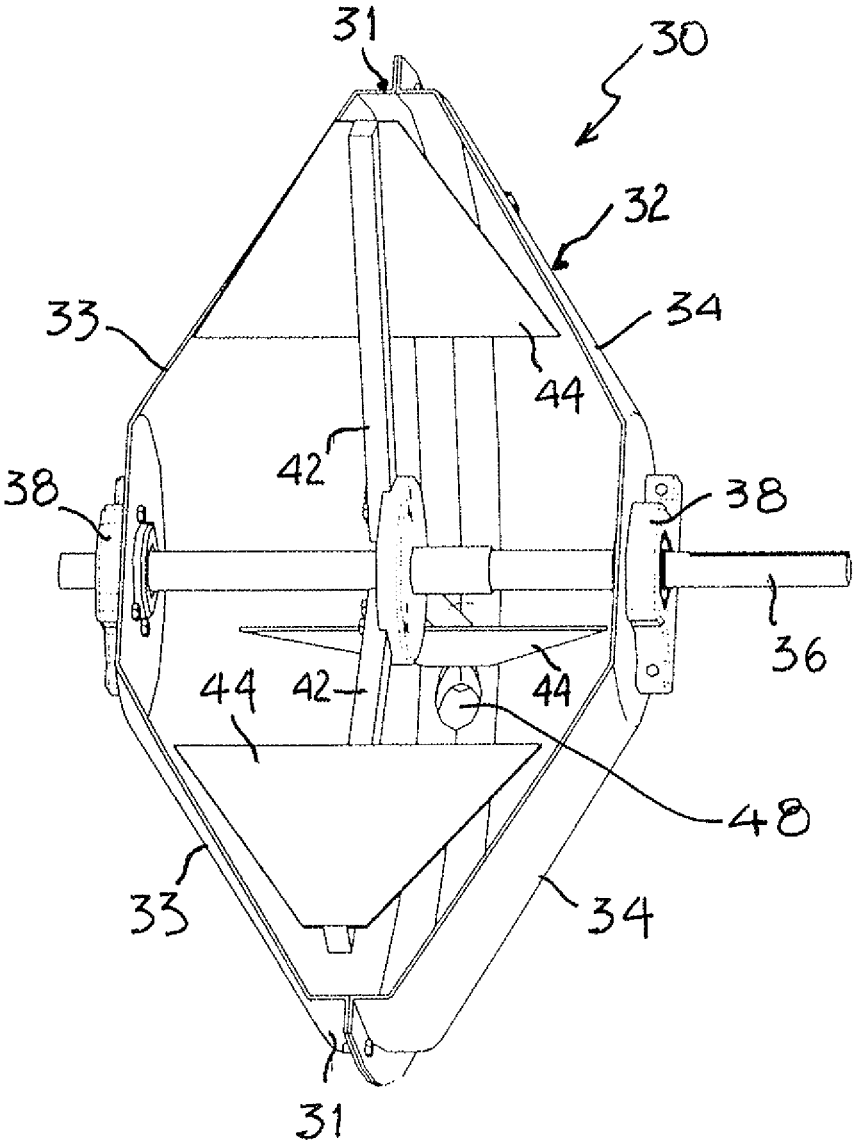
FIG. 4 is a schematic perspective sectional view of another part of the apparatus of FIG. 1.
Figure 5:
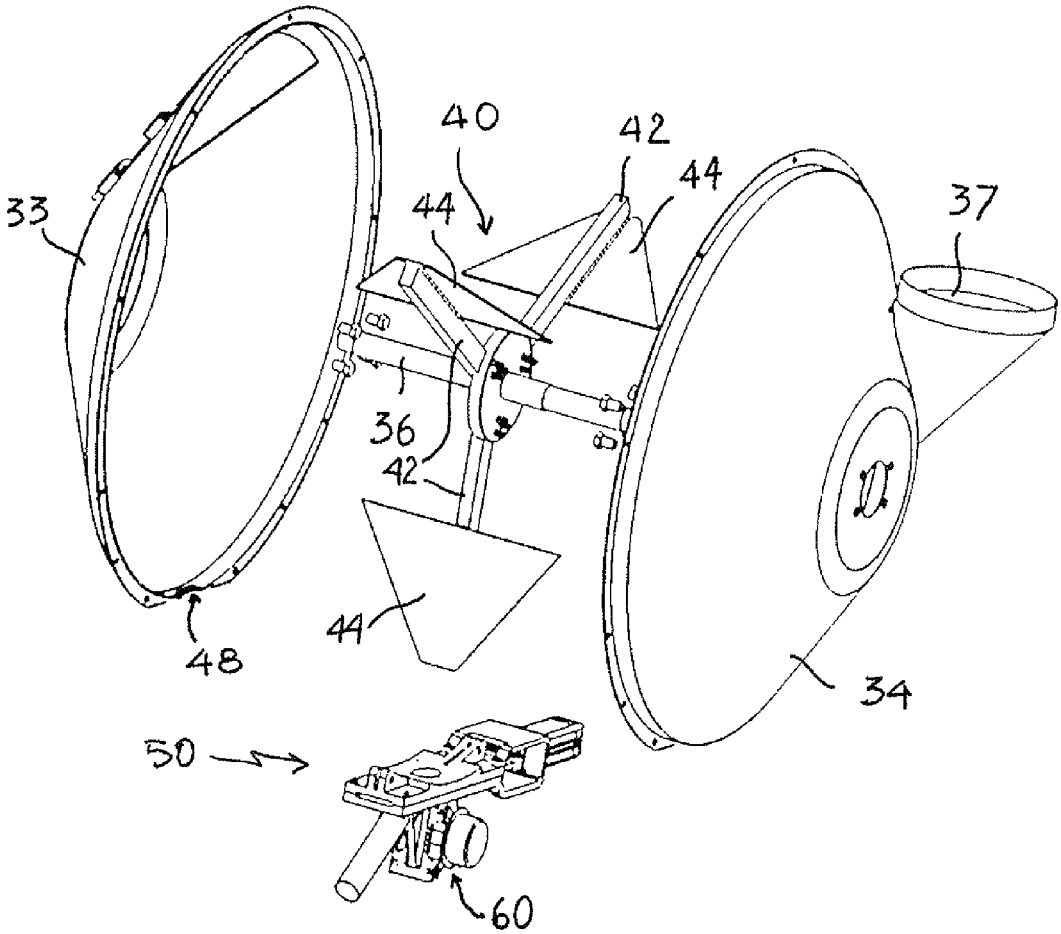
FIG. 5 is an exploded view of the part of FIG. 4, showing also another part of the apparatus of the invention.
Figure 6:
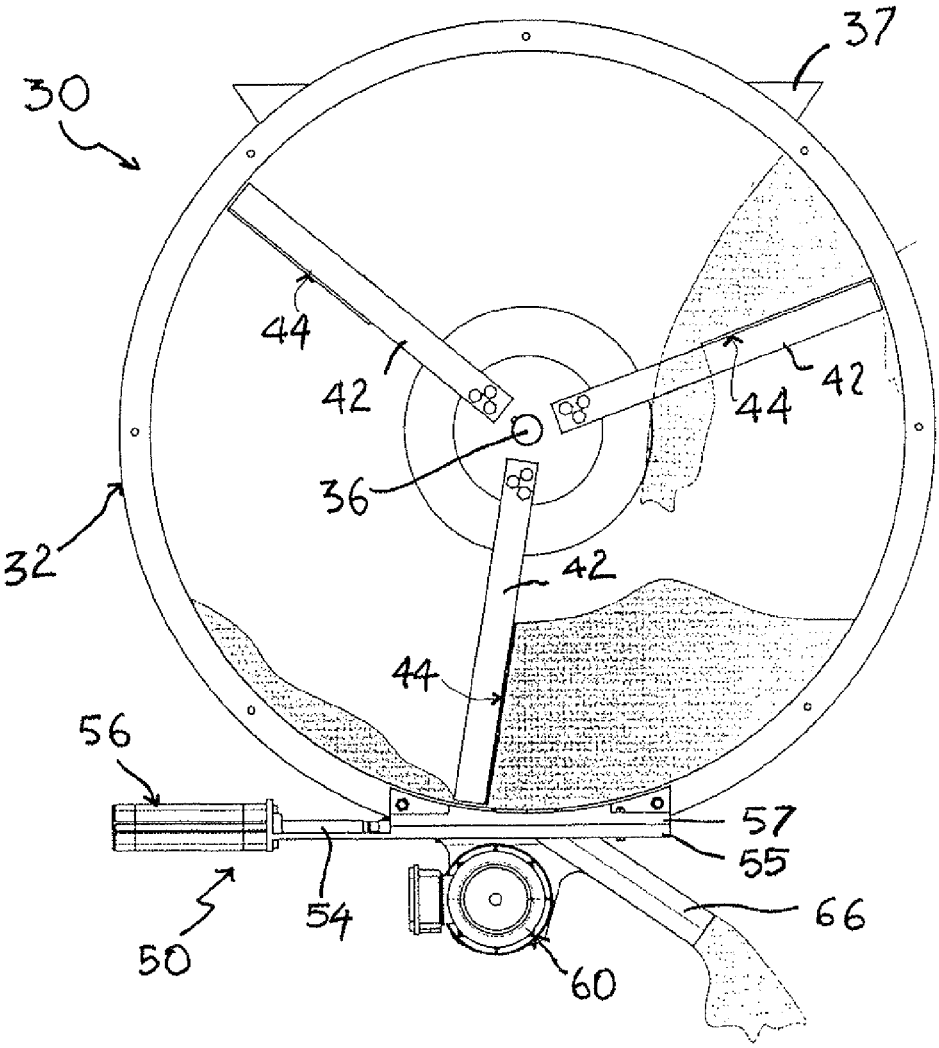
FIG. 6 is a partial sectional view in elevation of the part of FIG. 4.
Figure 7:
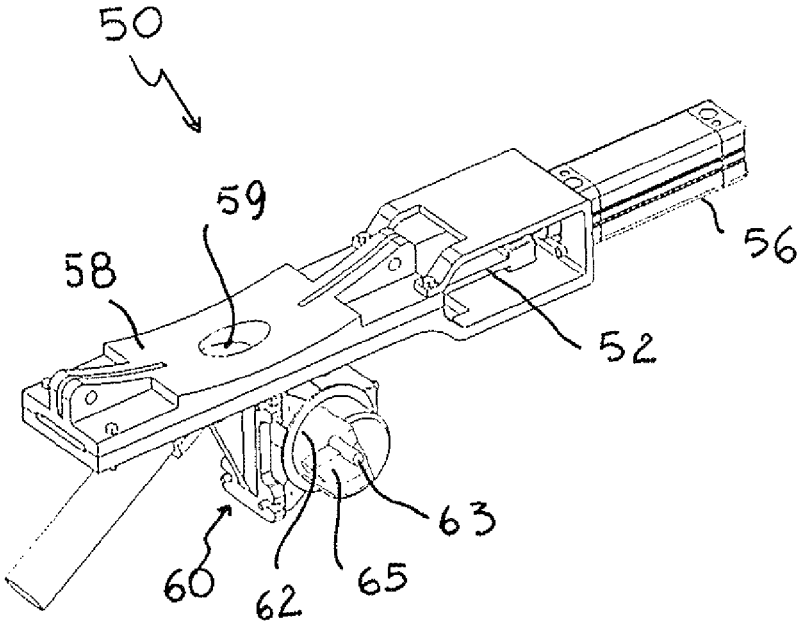
FIG. 7 is a schematic perspective view of the part shown at the bottom of FIG. 5.
Figure 8:
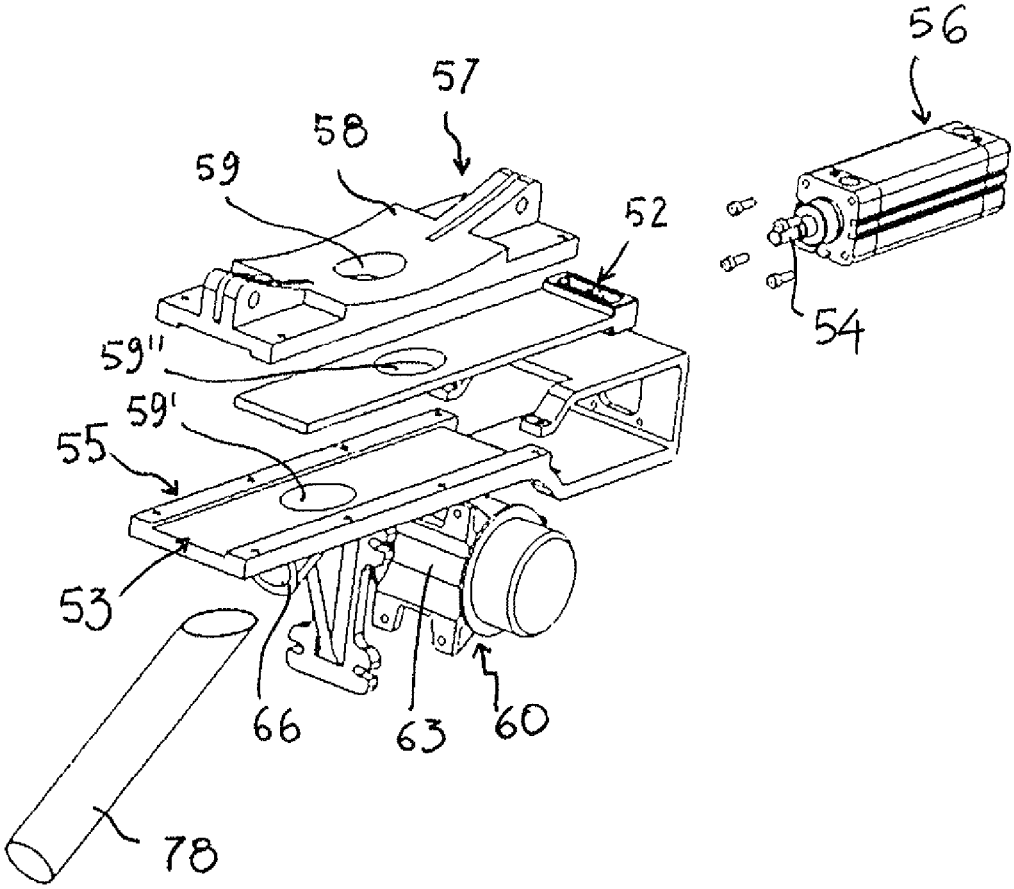
FIG. 8 is an exploded view of the part of FIG. 7.
Figure 9:
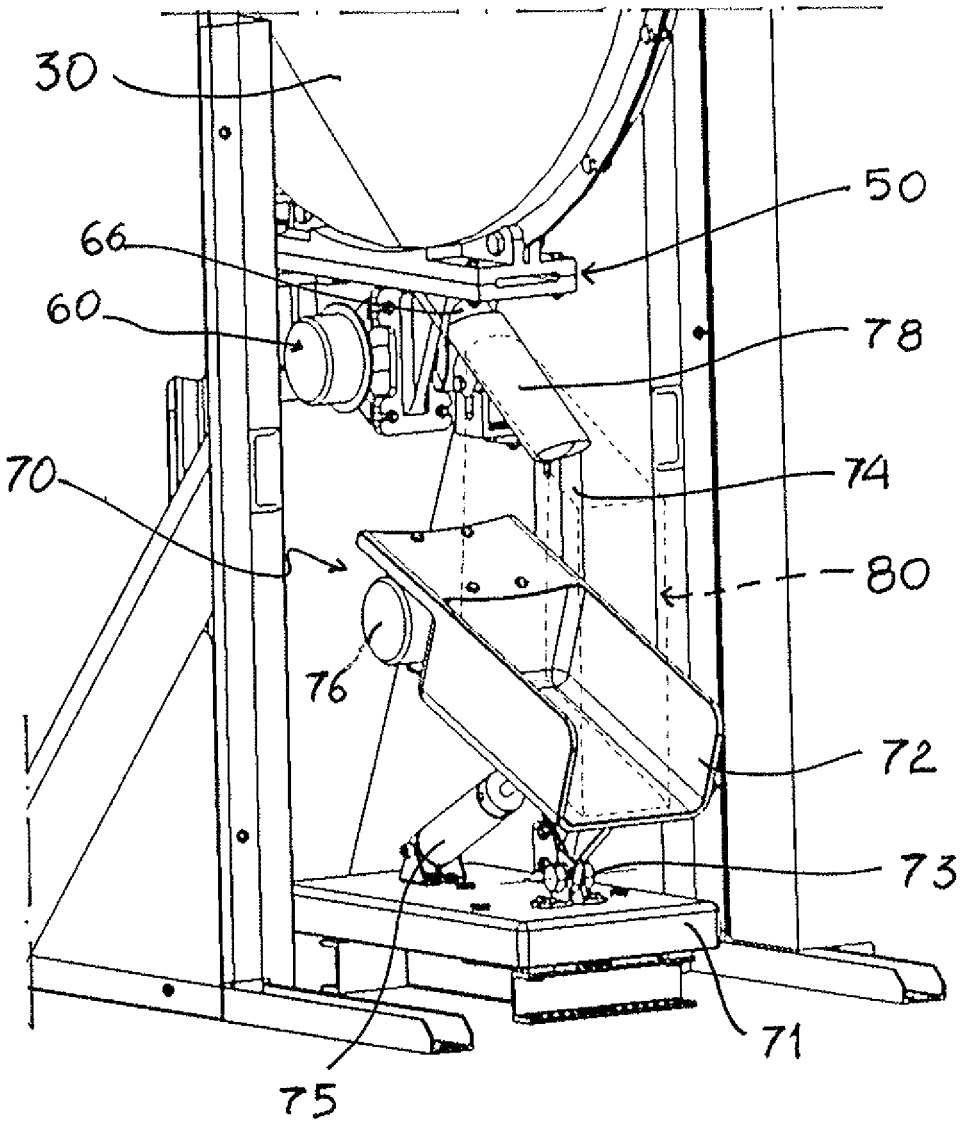
FIG. 9 is a schematic perspective view of a further part of the apparatus of FIG. 1.

The components of the solid particulate material that have been metered according to a desired recipe are thus discharged into a mixer 30, shown in more detail in FIGS. 4, 5 and 6. Mixer 30 comprises a stationary casing 32 mounted on a structure 29, shown in FIGS. 1-2. Stationary casing 32 is formed by two opposed frusto-conical walls 33,34 connected at their major bases by a cylindrical section 31 and disposed with their axis aligned horizontally. A horizontal shaft 36 is rotatably mounted on bearing 38 located in the minor bases of the frusto-conical walls 33, 34, along the axis thereof. Horizontal shaft 36 can rotate upon actuation of driving means located outside said casing, such as motor 39.

A mixing tool 40 is mounted on horizontal shaft 36. The mixing tool 40 comprises a plurality of spokes 42 mounted on the centre of the portion of shaft 36 contained within casing 30. Each spoke 42 supports a trapezoidal blade 44, the periphery of which reaches the proximity of, but is out of contact with, frusto-conical walls 33, 34. In the embodiment shown in the figures there are three spokes 42 and three blades 44, spaced by an angle of 120°. The shape of blades 44 is trapezoidal and matches the shape of the portion of casing 30 opposed to the blades. The shape of the blades 44 is preferably an isosceles trapezoid. The inclination of the sides of the trapezoid-shaped blade is the same as the inclination of the corresponding frustum of conical walls 33, 34.

The components of the material to be mixed are discharged from hopper 22 into an upper loading port 37 provided in the frusto-conical wall 34 of casing 32 (FIG. 5).

In the mixer the mixing tool 40 is set to rotate at a peripheral speed preferably exceeding 30 m/min. At such speed the solid particulate material behaves as if it were a liquid, so that the components are mixed quickly and efficiently. The mixing efficiency in a device having blades with a trapezoidal shape is much higher than in conventional mixing systems, as the material falls continuously into the centre of casing 32, and therefore it is subjected not only to intense localized mixing but also to intense overall mixing in the device. The time required to achieve uniform mixing is typically of less than 60 seconds.

FIGS. 5, 6, 7, and 8 show that casing 32 is provided with a discharge 48 port in the cylindrical section 31, associated to a discharge valve 50 mounted on the bottom of the casing.

Discharge valve 50 comprises a sliding plate 52 connected at one end to a piston 54 of a pneumatic cylinder 56. Plate 52 slides in a housing 53 provided in the lower half casing 55 of valve 50. An upper half casing 57 is mounted on the lower half casing 55 so that a space is defined in-between for plate 52 to slide upon actuation of cylinder 56. The upper side of upper half casing 57 has a concave central portion 58 that matches the curve of bottom portion of casing 32 of the mixer 30. A hole 59 is provided in the concave central portion of upper half casing 57, and valve 50 is mounted on mixer 30 with hole 59 aligned with hole 48 (FIG. 4). A hole 59' is provided in lower half casing 55, also aligned with hole 59 of the upper half casing 57. A hole 59" is provided also in the sliding plate 52 of valve 50, so that hole 59" can be aligned with holes 59, 59' when valve 50 is open. In such position the solid particulate material that has been mixed in mixer 30 can be discharged from the mixer through holes 59, 59", 59'. Upon actuation of cylinder 56 sliding plate is moved to a position in which there is no alignment and overlapping of holes 59 and 59", so that hole 59 is closed. In such position the solid particulate material is retained in mixer 30. Opening and closing of valve 50 can be effected with a desired speed, to help discharging the material.

Discharge of solid particulate material from mixer 30 is achieved by the combined action of gravity and slow rotation of the mixing tool 40, since blades 44 push the material toward bottom hole 48. To help discharging the material, valve 50 is equipped with a vibrating device 60, mounted on the bottom of valve 50. Vibrating device 60 comprises a casing defining an inner cylindrical room 62, housing a shaft 63 provided with cams 65. Shaft 63 is actuated by driving means not shown. Upon rotation of shaft 63 the cams 65 hit the wall of room 62, generating vibrations that are transmitted to valve 50 to avoid clogging of material and help the flow of material from mixer 30. Rotation of shaft 63 can be effected with a desired speed, to generate a desired amount of vibration that help discharging the material The material is thus conveyed to an inclined outlet pipe 66 connected to hole 59'.

A metering and packaging unit 70 is located downstream mixer 30, more precisely below discharge valve 60.

Unit 70 comprises a dish 72 suitable to support a bag 80 to be filled with the solid particulate material discharged through pipe 66. Dish 72 is equipped with metering means not shown, located under the base 71 of unit 70, preferably based on load cells, as known in the field of industrial weighing systems. Filling of bags 80 can thus be controlled so that discharge of the material from mixer 30 is stopped after a bag 80 has filled with a desired amount of material. A vibrating device 76 helps filling and packing the material into bag 80. Plate 72 is connected to a cylinder 75 that can be actuated to tilt plate 72 around a pin 73 to download bag 80 when filled. A portion of pipe 78 is connected at the top of a vertical rod 74 fixed to the base 71 of unit 70. The diameter of pipe 78 is larger than the diameter of outlet pipe 66 of the discharge vale 50, so that this latter is introduced into pipe 78. In turn pipe 78 is introduced into the mouth of bag 80, to facilitate filling.

Operation of the apparatus of the invention is done typically with the assistance of central control means—typically a computer with a suitable software—which control each component of the apparatus to ensure that proper functions are executed. For example, the speed of rotation of the mixing tool 40 of mixer 30 is set and controlled at a desired value, and can be the same or different during the steps of mixing and of discharging the material through valve 50. Also, opening and closing cycles of valve 50 and vibration of vibrating device 60 are controlled by central control means. Operation of the entire apparatus is controlled to achieve metering and mixing of the components according to a desired recipe of the material to be processed and packaged.

The method and apparatus according to the present invention allow to manufacture a solid particulate material starting from separate components in an efficient way, directly at a resale site, if desired. The apparatus is compact and simple to operate, and allows to use low-value components such as sand and cement typically available at a resale site, thus avoiding the need to transport large volumes of materials.

The invention claimed is:

1. Apparatus for producing solid particulate material, comprising storage tanks for separately storing at least two different components of a solid particulate material, and further comprising:

a) a metering unit for said components of a solid particulate material, said metering unit comprising a hopper having an opening at the bottom provided with a closure disc arranged to be in a closed position or in an open position to discharge said solid particulate material from said metering unit by gravity;

b) a mixer comprising, a stationary casing provided with a rotating fluxing tool, wherein said stationary casing of said mixer comprises an upper loading port and said mixing tool is mounted on a rotating horizontal shaft actuated by driving means located outside said casing, wherein:

said casing comprises two frusto-conical walls joined at their bases and disposed with their axis aligned horizontally, said shaft being mounted horizontally along said axis of said frusto-conical walls;

said mixing tool comprises a plurality of spokes mounted on the center of the portion of said shaft contained within said casing, each of said spokes being provided with a blade in the proximity of, but out of contact with said frusto-conical walls;

said casing being provided with an upper loading port provided in said frusto-conical walls and with a discharge port associated to a discharge valve mounted on the bottom of said casing;

c) said discharge valve mounted on the bottom of said casing of said mixer and configured to allow discharge of said solid particulate material by the combined action of gravity and rotation of the mixing tool; and d) a metering and packaging unit located downstream said mixer below said discharge valve;

wherein discharge said sold particulate material from said metering unit directly enters the mixer.

2. Apparatus according to claim 1, wherein said two opposed frusto-conical walls of said stationary casing are connected at their major bases by a cylindrical section.

3. Apparatus according to claim 1, wherein said blades have a trapezoidal shape.

4. Apparatus for producing solid particulate material, comprising storage tanks for separately storing at least two different components of a solid particulate material, and further comprising:

a) a metering unit for said components of a solid particulate material;

b) a mixer comprising a stationary casing provided with a rotating mixing tool, wherein said stationary casing of said mixer comprises an upper loading port and said mixing tool is mounted on a rotating horizontal shaft actuated by driving means located outside said casing, wherein;

said casing comprises two frusto-conical walls joined at their bases and disposed with their axis aligned horizontally, said shaft being mounted horizontally along said axis of said frusto-conical walls;

said mixing tool comprises a plurality of spokes mounted on the centre of the portion of said shaft contained within said casing, each of said spokes being provided with a blade in the proximity of, but out of contact with, said frusto-conical walls;

said casing being provided with a discharge port associated to a discharge valve mounted on the bottom of said casing c) a discharge valve mounted on the bottom of said mixer; and d) a metering and packaging unit located downstream said mixer;

wherein said discharge valve comprises a plate slidably mounted in a housing provided in a lower half casing of said valve, which also comprises an upper half casing having a concave central portion that matches a bottom portion of casing of mixer, a hole being provided in said concave central portion of said upper half casing, a corresponding hole being provided in said lower half casing, and hole being provided in said sliding plate, so that said holes are aligned when said valve is open.

5. Apparatus for producing solid particulate material, comprising storage tanks for separately storing at least two different components of a solid particulate material, and further comprising:

a) a metering unit for said components of a solid particulate material;

b) a mixer comprising a stationary casing provided with a rotating mixing tool, wherein said stationary casing of said mixer comprises an upper loading port and said mixing tool is mounted on a rotating horizontal shaft actuated by driving means located outside said casing, wherein;

said casing comprises two frusto-conical walls joined at their bases and disposed with their axis aligned horizontally, said shaft being mounted horizontally along said axis of said frusto-conical walls;

said mixing tool comprises a plurality of spokes mounted on the centre of the portion of said shaft contained within said casing, each of said spokes being provided with a blade in the proximity of, but out of contact with, said frusto-conical walls;

said casing being provided with a discharge port associated to a discharge valve mounted on the bottom of said casing c) a discharge valve mounted on the bottom of said mixer; and d) a metering and packaging unit located downstream said mixer;

wherein a vibrating device is mounted on the bottom of said valve, said vibrating device comprising a casing housing a rotatable shaft provided with cams that upon rotation of said shaft generate vibrations that are transmitted to said valve.

6. Apparatus according to claim 1, wherein said metering and packaging unit comprises a dish to support a bag to be filled with said solid particulate material, said dish being equipped with metering means, said plate being connected to means to download said bag when filled.

7. Apparatus according to claim 6, wherein said metering and packaging unit comprises a pipe connected at the top of a vertical rod, said pipe being associated to said discharge vale to receive the material discharged from said valve, said pipe being operatively introduced into said bag, to facilitate filling.

8. Apparatus according to claim 1, wherein one or more of said storage tanks are movably mounted on a supporting structure.

9. Apparatus according to claim 8, wherein said storage tanks are mounted on two superimposed rows and the storage tanks of the upper row are movably mounted on a supporting structure.

* * * * *